US006059090A

United States Patent [19]

Davis et al.

[11] Patent Number: 6,059,090

[45] Date of Patent: May 9, 2000

[54] CONFIGURABLE CASHBOX

[75] Inventors: Bruce W. Davis; Gregory E. Stoltz, both of Dallas; Algert J. Maldanis, Heath, all of Tex.

[73] Assignee: Agent Systems, Inc., Dallas, Tex.

[21] Appl. No.: 09/059,694

[22] Filed: Apr. 13, 1998

[51] Int. Cl.[7] ..... G07F 9/06; G07B 15/00

[52] U.S. Cl. ..... 194/350; 232/15

[58] Field of Search ..... 194/206, 207, 194/350; 232/15, 16; 221/242; 902/13

[56] References Cited

U.S. PATENT DOCUMENTS

| | | | |
|---|---|---|---|
| 4,186,977 | 2/1980 | Gilovich et al. | 232/15 |
| 5,224,579 | 7/1993 | Brown | 194/350 |
| 5,595,129 | 1/1997 | Grobe | 232/15 |

FOREIGN PATENT DOCUMENTS

| | | | |
|---|---|---|---|
| 80/01852 | 9/1980 | WIPO | 221/242 |

*Primary Examiner*—Robert P. Olszewski
*Assistant Examiner*—Bryan Jaketic
*Attorney, Agent, or Firm*—Fulbright & Jaworski L.L.P.

[57] ABSTRACT

A cashbox having a configurable note to coin storage area ratio is disclosed. Accordingly, the cashbox may be adjusted to accept a larger or smaller number of notes and a smaller or larger number of coins, respectively, depending on the circumstances of deployment of the configurable cashbox. Preferably, the note storage area is adapted to accept and retain notes in a tight stack suitable for easy removal and machine sorting and/or counting. In a preferred embodiment, the configurable cashbox is secure in that the cashbox locks into a housing with only limited access provided to the note and coin storage areas to allow deposit of cash into the cashbox. In order to remove the cashbox from the housing, access to the note and coin storage areas is secured such that once the cashbox is independent from the housing any unauthorized access to the storage areas is easily detectable. Preferably, to aid in tracking individual cashboxes and/or for use in accounting for the monies collected in a particular cashbox, the cashbox includes a machine readable identification.

58 Claims, 9 Drawing Sheets

CONFIGURABLE CASHBOX

REFERENCE TO RELATED APPLICATIONS

The present application is related to concurrently filed, co-pending, and commonly assigned United States patent applications entitled: "SYSTEM AND METHOD FOR PROVIDING FAREBOX ACCOUNTABILITY," Ser. No. 09/059,241, "AUTOMATIC VALIDATING FAREBOX SYSTEM AND METHOD," Ser. No. 09/059,274; and "SYSTEM AND METHOD FOR COIN SINGULATION," Ser. No. 09/060,033, the disclosures of which three applications are incorporated herein by reference.

TECHNICAL FIELD OF THE INVENTION

The present invention relates to the secure acceptance and storage of currency and, more particularly, to a cashbox providing separate storage of currency notes and currency coins wherein the ratio of note to coin storage may be adjusted.

BACKGROUND OF THE INVENTION

It is common today to provide for the automated acceptance of currency in transactions. For example, transit busses in the United States and Canada are normally equipped with fareboxes to collect fares from riders and securely store the coins, tokens, and bills used to pay these fares.

In order to provide secure storage and/or to allow for the transportation of the collected fares between the busses, where they are initially received, to a money room where they are sorted, accounted, and prepared for deposit, the fareboxes typically include some form of cashbox. However, typical prior art cashboxes often are not designed for the most efficient storage and handling of collected currency.

Typically prior art cashboxes include a simple cavity in which to receive and store currency. Accordingly, as currency notes are accepted, they are deposited in the cavity loosely to collect randomly at the bottom of the cavity. As such, the collected bills may curl, fold, and rest in different orientations to require a much larger area for storage than if the notes were neatly stacked in a same orientation.

These cashboxes may include separation of currency notes and currency coins. However, such cashboxes are often provided only with a single opening, typically at the top of the cashbox, through which to both receive currency and dispense currency. Accordingly, once removed from the bus farebox, the cashbox is typically inverted to remove the currency stored therein. As both the note and coin storage areas include a common opening, inversion of the cashbox may result in the extracted coins and notes becoming intermingled. This requires sorting by hand in order to separate the coins and notes.

In the prior art the notes are stored loose in the cashbox. As such, the notes are neither stacked or faced, i.e., having the front of each bill facing the same direction, as required by automated note sorting and counting apparatus. Accordingly, hand sorting must generally be relied upon to stack and face the notes.

The ratio of collected coins to notes may vary depending on circumstances such as a particular route a bus travels or a change in fares where the standard fare is changed from a fraction of a dollar to a whole dollar amount. However, typical prior art cashboxes do not provide adjustability of the coin and note storage areas. Instead, these storage areas are simply designed to be large enough to accommodate the largest amount of coins likely as well as the largest amount of notes likely. However, this brute force design technique, although simple to implement, does not provide an efficient use of a limited amount of space.

A further disadvantage of the typical prior art cashbox is in accounting for receipts of individual busses. For example, because of the aforementioned problems in sorting the monies collected in prior art cashboxes, the receipts of multiple cashboxes are generally intermingled requiring hand sorting. However, this does not provide any means by which the receipts of a particular cashbox may be accounted for.

Accordingly, a need exists in the art for a cashbox which securely stores collected coins and notes discretely.

A further need exists in the art for the cashbox to conveniently present the stored coins and notes separately for accounting purposes.

A still further need exists in the art for the storage of notes by the cashbox to be in a tight stack having a common orientation and common facing.

SUMMARY OF THE INVENTION

These and other objects, features and technical advantages are achieved by a system and method which provides a secure cashbox adapted to lockably engage in a currency acceptance host, such as the validating farebox shown and described in the above referenced patent application entitled "Automatic Validating Farebox System and Method," in an open condition to receive currency from the host. When engaged in the host, the cashbox of the present invention, in combination with the host, preferably prevents access to the currency storage areas of the cashbox, except through the host, to provide secure storage of the received currency while the cashbox is engaged. To maintain this secure storage of the received currency even when the cashbox is disengaged, the cashbox of the present invention preferably includes a closing mechanism, such as a door, which must be fully closed and locked, thereby preventing any access to the currency storage areas of the cashbox, in order to disengage the cashbox from the host.

The cashbox of the present invention is preferably adapted to provide differing ratios of currency storage, i.e., selectable amounts of currency note storage area and, therefore, inverse amounts of currency coin storage area. This aspect of the present invention is preferably provided through the use of a cashbox housing or case which at least in part defines the currency coin storage area. The cashbox housing is adapted to receive a currency note storage insert. The currency note storage insert, when received into the cashbox housing defines the currency coin storage area in combination with the cashbox housing. By selecting and inserting a currency note storage insert of a desired size, both the currency note storage area and the currency coin storage area of the cashbox of the present invention may be changeably selected.

Preferably, the currency note storage area of the present invention is adapted to efficiently store notes. For example, in a preferred embodiment of the present invention, the currency note storage insert includes a note receiver surface to support the planar surface of an unfolded note, i.e., the face or the back of a bank note. This surface is preferably biased, such as with a compression spring or compressed resilient material, such as closed cell poly-urethane foam, to exert a force against the surface of the notes. This biased surface in combination with a note retainer surface, such as note edge holders disposed at the opening of the currency note storage insert, operate to compress the received notes in a tight stack to allow for storage of many more currency notes than if they were allowed to drift freely in any orientation in the currency note storage area.

In order to assist in providing accountability for the currency received into the cashbox, such as where a large number of cashboxes are used in a plurality of hosts under control of a number of operators, the preferred embodiment of the present invention includes machine readable identification of the particular cashbox. This machine readable identification is disposed on the cashbox to allow for its reading by the host when the cashbox is engaged therewith and for reading by other devices, such as a cash cart or currency receiving device, which may be coupled to the cashbox in transferring currency. Accordingly, the host will have identification information with respect to a particular cashbox into which the host entrusted currency and, thereafter, subsequent devices handling the transfer of the currency will have the identification information to provide an audit trail of the received currency.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Figure 1:
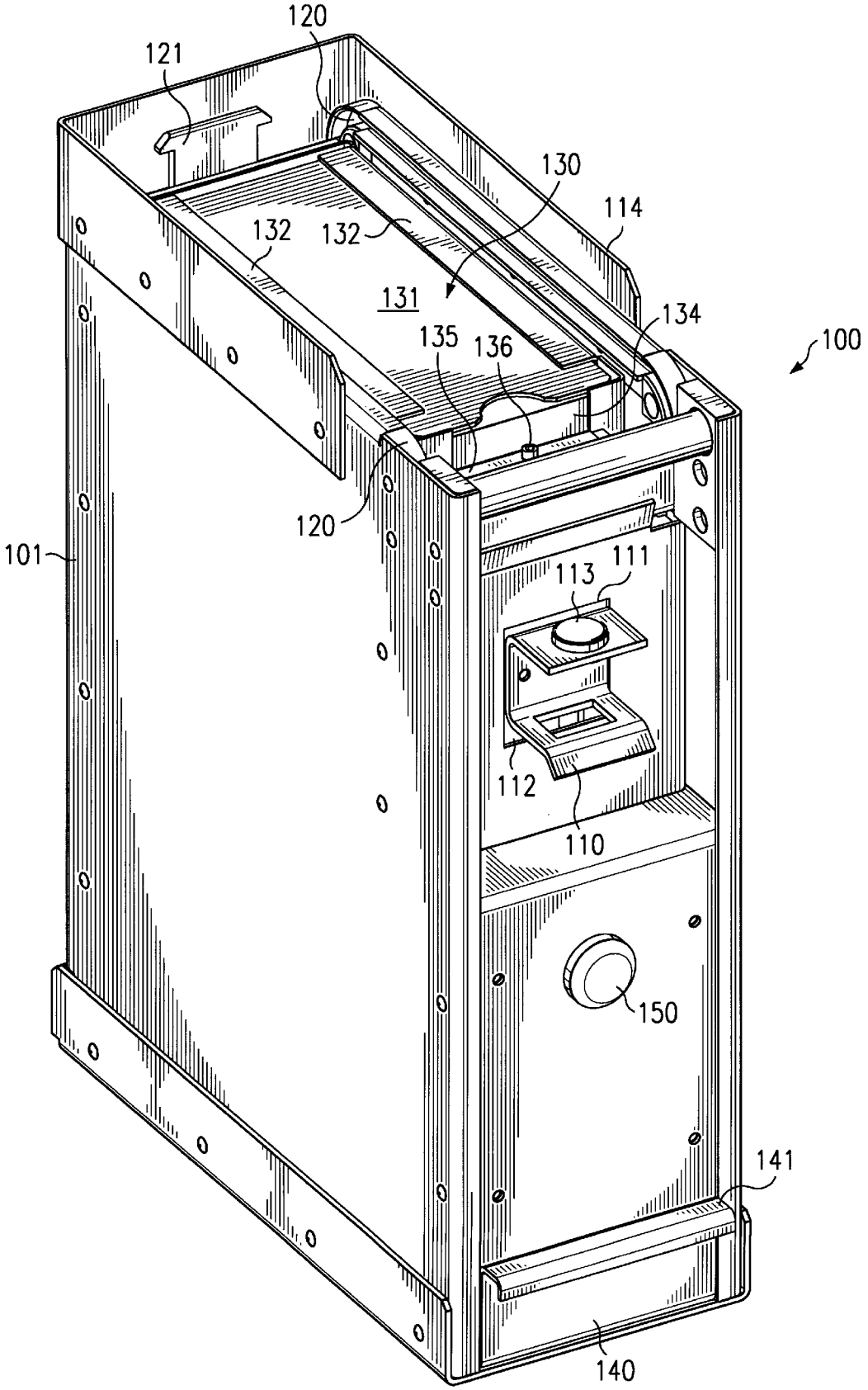
FIG. 1 shows an isometric view from the front left of a preferred embodiment of the cashbox of the present invention.

Directing attention to FIG. 1, a preferred embodiment of the cashbox of the present invention is shown in an isometric view from the front left. Cashbox 100 includes case 101 preferably containing an adjustable note storage area and a coin storage area.

A preferred embodiment of the adjustable note storage area is shown as note storage insert 130, visible at the top of cashbox 100, held in case 101 by tab 135 and screw 136. Preferably note storage insert 130 presents an opening approximately the size of the planar surface of a note to be accepted. Accordingly, the depth of note storage insert 130 will establish the volume of note storage area available within the note storage insert. By providing a number of different depth note storage inserts, each removably couplable to case 101, such as by tab 135 and screw 136, varying amounts of note storage area may be selected within cashbox 100.

It shall be appreciated that note storage area 130 may also be utilized for storage of items other than legal tender. For example, bus passes or transfers, which are automatically verifiable by a host system coupled to cashbox 100, may be stored in storage area 130 for later separation such as by automated currency sorters. Alternatively, such as where a large number of these other items are expected, cashbox 100 may be adapted to separately store these items. For example, cashbox 100 may be adapted to include multiple ones of note storage insert 130 to separately store notes and the other items (or even to separately store different denominations of notes). Of course, in this alternative embodiment, the host to which cashbox 100 is coupled would be required to provide separate feed paths for the items to be stored separately.

Preferably the coin storage area of cashbox 100 is approximately the interior volume of case 101 remaining after insertion of note storage insert 130. Accordingly, adjusting of the storage area available for notes within cashbox 100 by insertion of different depth note storage inserts will result in an inversely related change in the storage area available for coin. This inverse relationship is desirable in many circumstances in which cashbox 100 may be deployed. For example, where cashbox 100 is deployed to receive passenger fares, such as in city busses, a standard fare which is a fraction of a dollar will typically necessitate a large coin storage area and a small note storage area, as most passengers will pay in coin. However, where the fare is not a fraction of a dollar, a large note storage area and a small coin storage area may be desirable, as most passengers will tender notes for their fare. It should be readily appreciated that the flexibility of the note storage insert of the present invention not only provides adjustment of the coin to note storage area ratios as desired, but also allows for the cashbox to be easily adjusted, such as when there is a fare change, i.e., an increase from a fraction of a dollar to a dollar may be easily accommodated by insertion of a larger note storage insert.

Cashbox 100 is anticipated to be used to securely transport received currency from a coin and note acceptor to a secure money handling facility, such as is described in the above referenced patent application entitled "System And Method For Providing Farebox Accountability." Therefore, cashbox 100 will not only be subject to security issues regarding accountability of the accepted currency, but will also be subject to physical upset possibly causing coins or notes to move within case 101 and become trapped, thus also creating issues regarding accountability of the accepted currency. The trapping of currency is especially a concern with respect to note storage insert 130 defining the coin storage area within case 101. Note storage insert 130, if not properly sized and adapted for insertion into case 101, may introduce voids in the coin storage area defined thereby which are likely to trap coins. For example, when transporting cashbox 100 between a coin and note acceptor from which currency has been received into the coin and note storage areas, if the cashboxes were turned upside down and then righted, coins may fall into voids from which they may not easily be extracted, much less be extricated by gravity as preferred when coin retainer 140 is opened as discussed hereinbelow.

Accordingly, the preferred embodiment of note storage insert 130 is adapted to present no voids in which coin may be trapped when inserted into case 101. This may be accomplished by utilizing a box having an open top and substantially smooth left, right, front, and back sides so as to not present a surface to trap coins when inserted into case 101. The size of this box may be sufficiently small so as to have its sides disposed a sufficient distance from the corresponding sides of case 101 so that coins are unlikely to become trapped there between. Alternatively, the size of this box may be sufficiently large so as to have its sides disposed adjacent to corresponding sides of case 101 so that coins are unable to pass there between. Of course a combination of the above two approaches may be utilized to provide some sides against the corresponding sides of case 101 and other sides a sufficient distance from the corresponding sides of case 101.

Alternatively, the note storage area may be defined by removable surfaces, such as a divider extending fully between the left, right, front, and back sides of case 101, which directly attach to sides of case 101 and therefore define the note storage area and the coin storage area without presenting voids to trap coins.

Still referencing FIG. 1, the preferred embodiment of note storage insert 130 includes note receiving surface 131 supported by bias 134 in order that note receiving surface 131 remain as near the note receiving opening of note storage insert 130 as possible. Note receiving surface 131 is disposed to support a planar surface of the notes to be stored, i.e., the face or the back of the notes, and is, therefore, preferably approximately the size of this surface.

Note storage insert 130 also includes note retaining rails 132. Note retaining rails 132 at least in part define the note receiving opening of note storage insert 130, and are disposed such that the opening is slightly smaller than a planar surface dimension of the notes to be stored.

Accordingly, force is required, such as may be provided by a note stacker plunger shown and described in the above referenced patent application entitled "Automatic Validating Farebox System And Method," in order to insert notes into the note storage insert for storage. This force causes the notes to deform sufficiently to pass the opening of the note storage insert which is slightly smaller in one dimension than the note. This force also causes the movement of support surface 131 away from the note receiving opening, by compression of bias 134 to provide storage for a newly received note. When this force is removed, bias 134 again forces support surface 131 toward the note receiving opening. This bias force causes the received notes to be compressed between support surface 131 and note retaining rails 132. As note retaining rails 132 are disposed to define a note receiving opening slightly smaller than a dimension of the planar surface of the received notes, the received notes are maintained in a tightly compressed stack in note storage insert 130.

Preferably, when engaged in the host, the cashbox of the present invention, in combination with the host, prevents access to the currency storage areas of the cashbox except through the host to provide secure storage of the received currency while the cashbox is engaged, and thus the note receiving opening is open to receive notes. Accordingly, the preferred embodiment shown in FIG. 1 includes guard 114 extending up beyond the note receiving opening. Guard 114 is disposed sufficiently close to a corresponding surface in the host, when cashbox 100 is engaged therein, to prevent access to the note storage area except through the host note feed path.

It shall be appreciated that, although the above discussion has been with reference to a note storage insert, the above features of note receiving and stacking may be accomplished by a cashbox which does not include a removable note storage insert. For example, the support surface and the retaining rails may be directly coupled to the case of the cashbox, if desired.

Preferably cashbox 100 includes a mechanism to securely close the note receiving opening and the coin receiving opening. Locking tab 121 of FIG. 1 is coupled to a preferred embodiment of a door, shown and described below with respect to FIG. 2, providing locking closure of the note receiving opening. Track 120, disposed on both sides of the note receiving opening provides for movable closure of the note receiving opening by a door.

Cashbox 100 preferably includes unlocking mechanism 150 coupled to the locking mechanism of the door to controllably release locking tab 121 when engaged holding the door closed over the note receiving opening. Accordingly, cashbox 100 may be transported, with currency therein, while providing limited access to the currency. Preferably unlocking mechanism 150 is in the form of a key tumbler. However, other forms of unlocking mechanisms may be employed, such as combination locks, electronic locks, including key card readers and the like, or even dual locks requiring the simultaneous operation by two trusted individuals.

Cashbox 100 also preferably includes coin retainer 140 slidably coupled to case 101 to allow for the rapid emptying of the coin storage area, such as through a coin release opening shown and described below with respect to FIG. 3. Preferably coin retainer 140 is locked in a closed position, to prohibit egress of coins from the coin storage area through a coin release opening, through a locking mechanism coupled to unlocking mechanism 150, as shown and described below with respect to FIG. 5. Accordingly, a single operation of unlocking mechanism 150 will provide access to both the note storage area, through unlocking a closed door, and the coin storage area, through unlocking a closed coin retainer.

Preferably, coin retainer 140 is adapted to prevent operation of cashbox 100 when in an open position. For example, coin retainer 140 may include extension 141 adapted to allow cashbox 100 to be accepted in a host when coin retainer 140 is in a closed and locked position, and to prevent cashbox 100 to be accepted in a host when coin retainer 140 is in an open position. Prevention of acceptance of cashbox 100 into the host is preferably accomplished through the use of a surface in juxtaposition with extension 141 of coin retainer 140 which does not allow cashbox 100 to fully engage itself within the host when extension 141 strikes the surface.

Preferably cashbox 100 includes a latch mechanism to restrict portability when engaged in a host for receiving currency. Still referencing FIG. 1, latch 110 is shown coupled to cashbox 100 by slider 112 through slot 111 in case 101. Latch 110 is disposed to receive a bolt rigidly attached to the host. Accordingly, only through operation of slider 112 may cashbox 100 be disengaged from the host when latch 110 mates with the host bolt. Operation of slider 112 to disengage latch 110 will be discussed in further detail hereinbelow.

Additionally, in a preferred embodiment of cashbox 100, slider 112 also has coupled thereto machine readable identification information unique to cashbox 100, such as a serial number of cashbox 100. Accordingly, cashbox 100 may be uniquely identified to a host when coupled thereto. The preferred embodiment of machine readable identification information is contained within an electronic memory such as that of touch memory utility (TMU) button 113 available from Dallas Semiconductor, Dallas, Tex. Accordingly, when coupled to a host, the memory of TMU button 113 may be read by the host to identify the particular cashbox 100 into which received currency is stored.

Alternatively, machine readable unique identification information of cashbox 100 may be provided through such means as non-electronic machine readable means, such as laser scannable bar codes or magnetic ink printed MICR codes. Additionally, the machine readable unique identification information of cashbox 100 may be provided through such means as a machine readable magnetic strip or smart card.

The use of TMU button 113 is preferred as this memory unit provides rugged and secure containment of the memory storing the identification information and is accessible only upon proper polling of the TMU button.

In an alternative preferred embodiment, the means for storing the unique identification information may also include additional memory areas and/or processor capacity in order to perform additional functions. For example, additional memory may be provided to record information from the host system to which it is coupled in order to provide this information to a subsequent host, such as for accounting purposes or creating a history with respect to the cashbox. For example, totals for the stored amounts of currency and/or transaction details may be stored by the host in the additional memory for use in accounting for the stored currency when the cashbox has been removed from the host. Accordingly, separate polling of the host may be omitted while still providing accountability of the fares collected.

Where processor capacity is included, a proprietary authorization routine may be required between the processor of cashbox 100 and a host before the host will allow any interaction with cashbox 100. Such a routine may be desired in order to prevent the coupling of only the machine readable identification information to the host and causing the host to deposit money into a cavity rather than secure confines of cashbox 100.

In a preferred embodiment of the present invention, unlocking mechanism 150 is disposed on the surface of case 101 in order to be inaccessible when cashbox 100 is engaged in the host. For example, the embodiment of FIG. 1 includes unlocking mechanism 150 on the same face of case 101 as latch 110 and extension 141, i.e., the front surface, of coin retainer 140. Accordingly, the same surface which prevents cashbox 100 from fully engaging the host when coin retainer 140 is in the open position may also prevent access to the unlocking mechanism. This arrangement is advantageous as the only access provided to the cashbox when engaged in the host is through the host. Accordingly, accounting for currency stored in the cashbox by the host may be strictly maintained.

Figure 2:
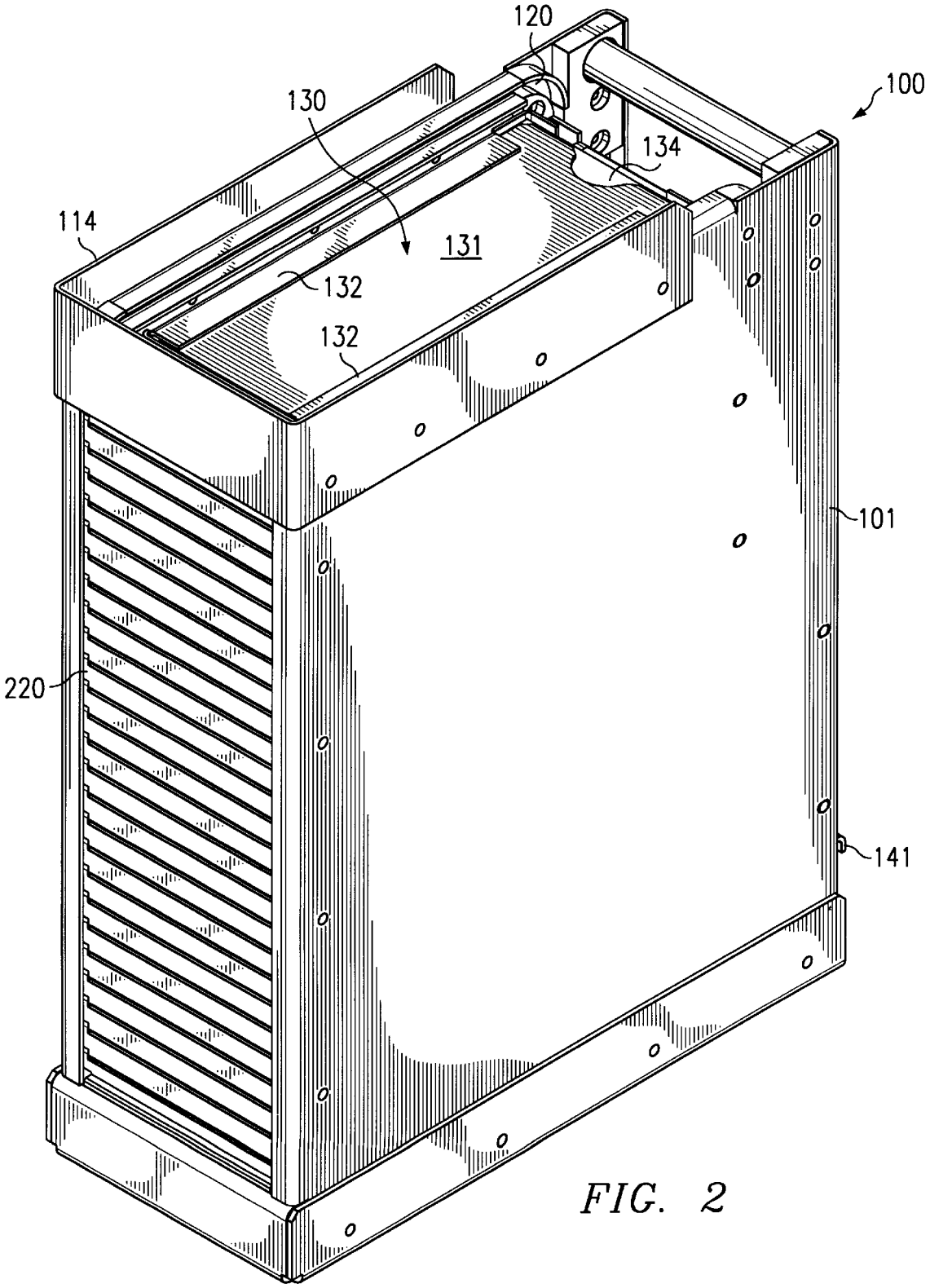
FIG. 2 shows an isometric view of the cashbox of FIG. 1 from the back left.

Directing attention to FIG. 2, an isometric view of cashbox 100 is shown from the back left. Here door 220, coupled to tab 121 of FIG. 1, is shown. Door 220 is in an open position to expose note storage insert 130 and allow for the receiving of notes therein.

Preferably door 220 is a tambour door, i.e., the door is comprised of interconnected louvered strips of rigid material, to allow door 220 to substantially conform to the contours of case 101. Accordingly, track 120, in which door 220 travels, includes radii to direct door 220 along the contour of case 101 when transitioning from open to closed positions.

However, in an alternative embodiment of the present invention, door 220 may include any number of doors suitable for enclosing the note storage area, such as a multiple folding door, a solid surface door, or a flexible surface door. For example, in an alternative embodiment door 220 is a rigid surface which is pivotally coupled to case 101. In this embodiment, door 220 may be coupled to slot 120, such as through pins in a front edge, to allow the rigid door to slide across the note receiving opening and thereby close the opening. When open, this embodiment of the door may slide back to reveal the note receiving opening and the open door pivot on the pins in slot 120 to allow the open door to be retained flush against the back surface of the case, i.e., the surface where tambour door 220 is illustrated in FIG. 2.

Figure 3:
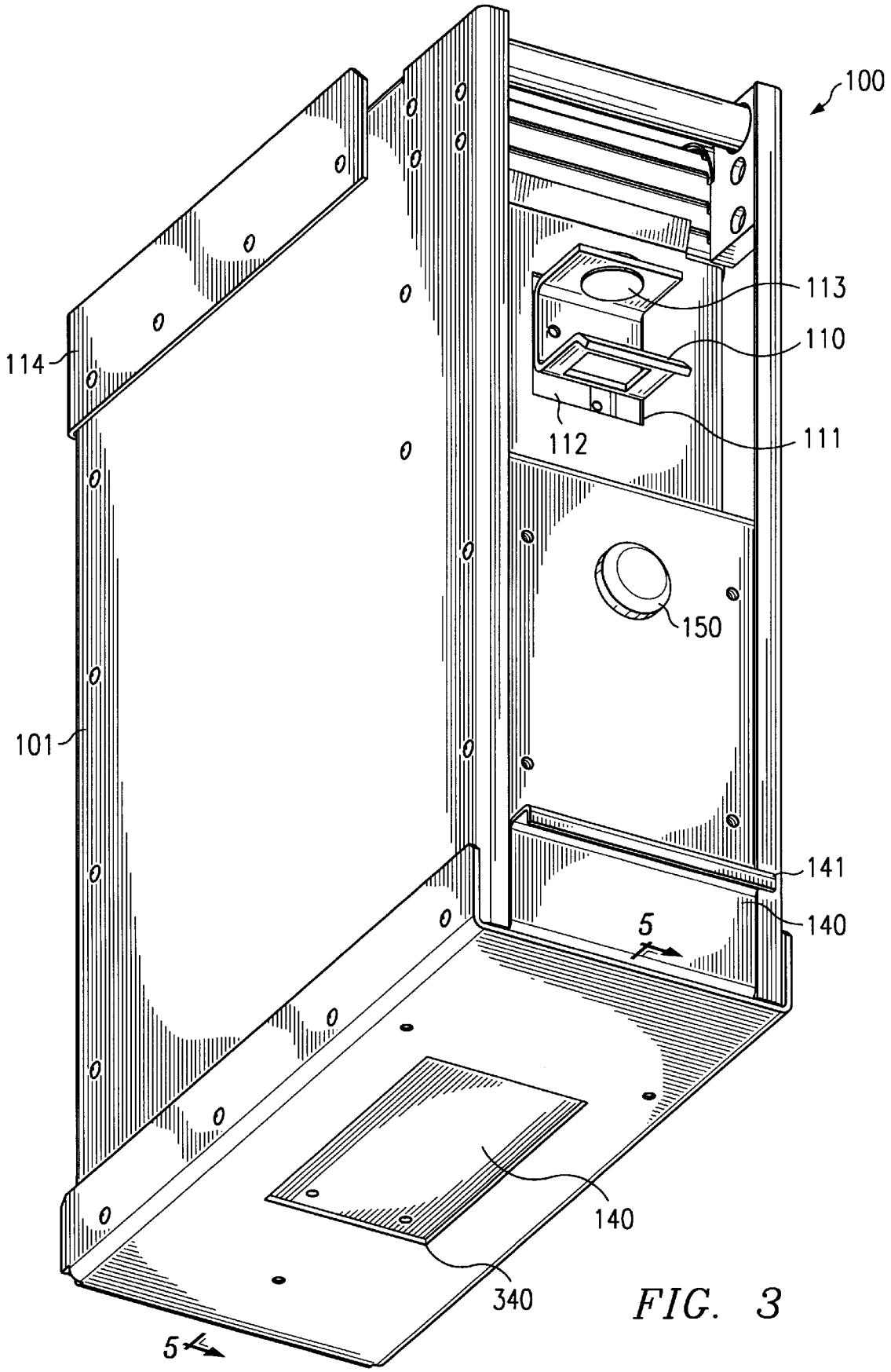
FIG. 3 shows the cashbox of FIG. 1 in an isometric view from the front left, looking up at the bottom.

Directing attention to FIG. 3, cashbox 100 is shown in an isometric view from the front left, looking up at the bottom of case 101. Accordingly, coin release opening 340 in case 101 can be seen. As coin retainer 140 is in a closed position, coin retainer 140 is visible through coin release opening 340. However, when coin retainer 140 is in an open position, coin release opening 340 exposes the coin storage area of cashbox 100 to allow the egress of coins stored therein.

The placement of coin release opening 340 on the bottom surface of case 101 is advantageous in that it allows cashbox 100 to be placed on top of a receiving device, such as a money room coin counter, wherein the opening of coin retainer 140 allows gravity to empty the coin storage area into the receiving device. The substantially complete emptying of the coin storage area by the force of gravity may be ensured through the use of surfaces sloped toward coin release opening 340 within the coin storage area of cashbox 100.

Additionally, by locating coin release opening 340 on a surface of case 101 other than that of note receiving opening, separate and simultaneous removal of stored coins and stored note may be accomplished when both door 220 and coin retainer 140 are in an open position. This separate removal of coins and notes is advantageous as it allows for efficient handling of stored currency as the coins and notes remain segregated and, therefore, may each be handled, sorted, and counted by automated means commonly available today. This advantage is further enhanced by the preferred embodiment of the present invention which stores the received notes in a common orientation and in a tightly compacted bundle, also adapted for handling, sorting, and counting by automated means commonly available today.

Figure 4:
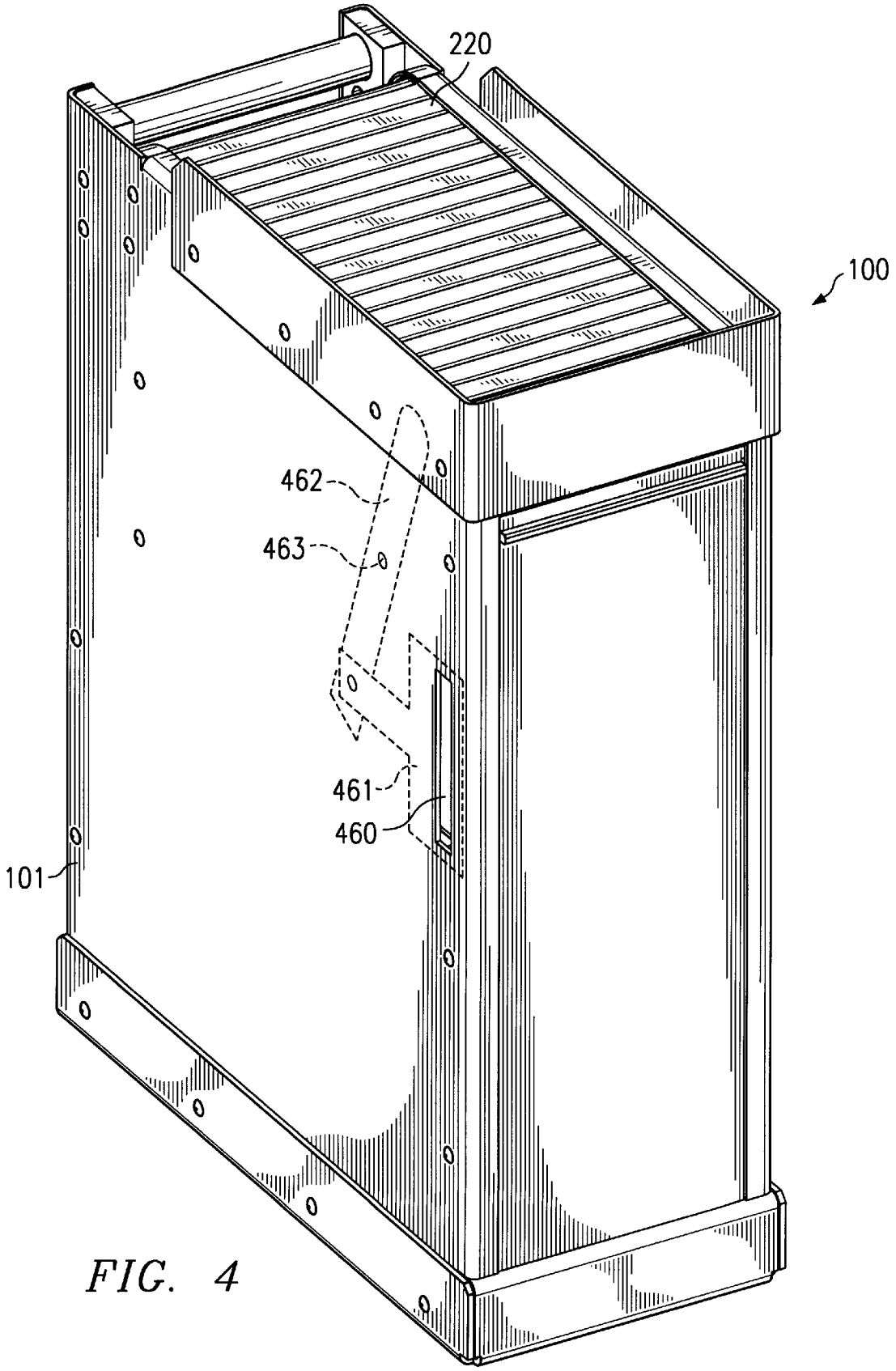
FIG. 4 shows the cashbox of FIG. 1 with a door in a closed position.

Directing attention to FIG. 4, cashbox 100 is shown with door 220 in a closed position. Accordingly, note storage insert 130 and its associated note receiving opening are not accessible when door 220 is in the closed position.

Also shown in FIG. 4 is coin receiving opening 460 in case 101. Coin receiving opening 460 is disposed to correspond with a coin chute in a host when cashbox 100 is received in the host. Accordingly, received coins will enter cashbox 100 through coin receiving opening 460 and be stored therein until extracted through coin release opening 340.

As discussed above, preferably, when engaged in the host, the cashbox of the present invention, in combination with the host, prevents access to the currency storage areas of the cashbox except through the host to provide secure storage of the received currency while the cashbox is engaged, and therefore the coin receiving opening is open for receiving coins. Accordingly, coin receiving opening 460 is disposed to be in juxtaposition with the coin chute in the host such that access to the coin storage area is prevented except through the host coin feed path.

It shall be appreciated that the maximum storage area for coins within case 101 will be approximately the area within case 101 below the lowest edge of coin receiving opening 460. Accordingly, coin receiving opening 460 is preferably disposed on a side of case 101 far enough from the bottom of case 101 to allow for a desired maximum amount of coin storage.

Furthermore, as the area of note storage within cashbox 100 is preferably adjustable, coin receiving opening 460 is preferably disposed in case 101 so as not to interfere with adjustment of the note storage area. Accordingly in a preferred embodiment of the present invention, coin receiving opening 460 is disposed toward the front or back of case 101 to allow a coin receiving gap to exist within the interior cavity of case 101 even when a large note storage area is selected which extends within case 101 below coin receiving opening 460.

It shall be appreciated that the alternate embodiment of the removable surface to define the note storage area wherein the surface extends from the left, right, front, and back sides of case 101 described above, could be adapted to accommodate allowing a coin receiving gap. For example, this surface may include several bends disposed to present a stepped surface allowing the coin receiving gap. Likewise, this surface may be "L" shaped so as to extend to the left and right and front or back, and top of case 101, thereby leaving a coin receiving gap at the front or back of the surface.

In order to provide secure storage of coins when cashbox 100 is disengaged from the host, the preferred embodiment of cashbox 100 includes a shutter to close coin receiving opening 460. A preferred embodiment of a shutter disposed inside of case 101 is shown in FIG. 4 as shutter 461. Shutter 461 is sufficiently sized to entirely cover coin receiving opening 460 when shutter 461 is in a closed position.

In order to provide secure closing of shutter 460 when cashbox 100 is disengaged from the host, the preferred embodiment of FIG. 4 includes lever arm 462 coupled to case 101 at pivot point 463. Accordingly, movement of the distal end of lever arm 462 will cause corresponding movement in proximal end of lever arm 462 to cause shutter 461 to close coin receiving opening 460. Preferably distal end of lever arm 462 is disposed within case 101 such that closing of door 220 also causes closing of shutter 460. Likewise, opening of door 220 will also cause opening of shutter 460. Such an arrangement is advantageous as when cashbox is engaged in a host and door 220 is opened to receive notes, so too is shutter 460 to receive coins. However, when door 220 is closed secure transporting of cashbox 100 may be accomplished with respect to both the note storage area and the coin storage area. This security of the coin storage area is provided without any additional operator intervention.

Figure 5:
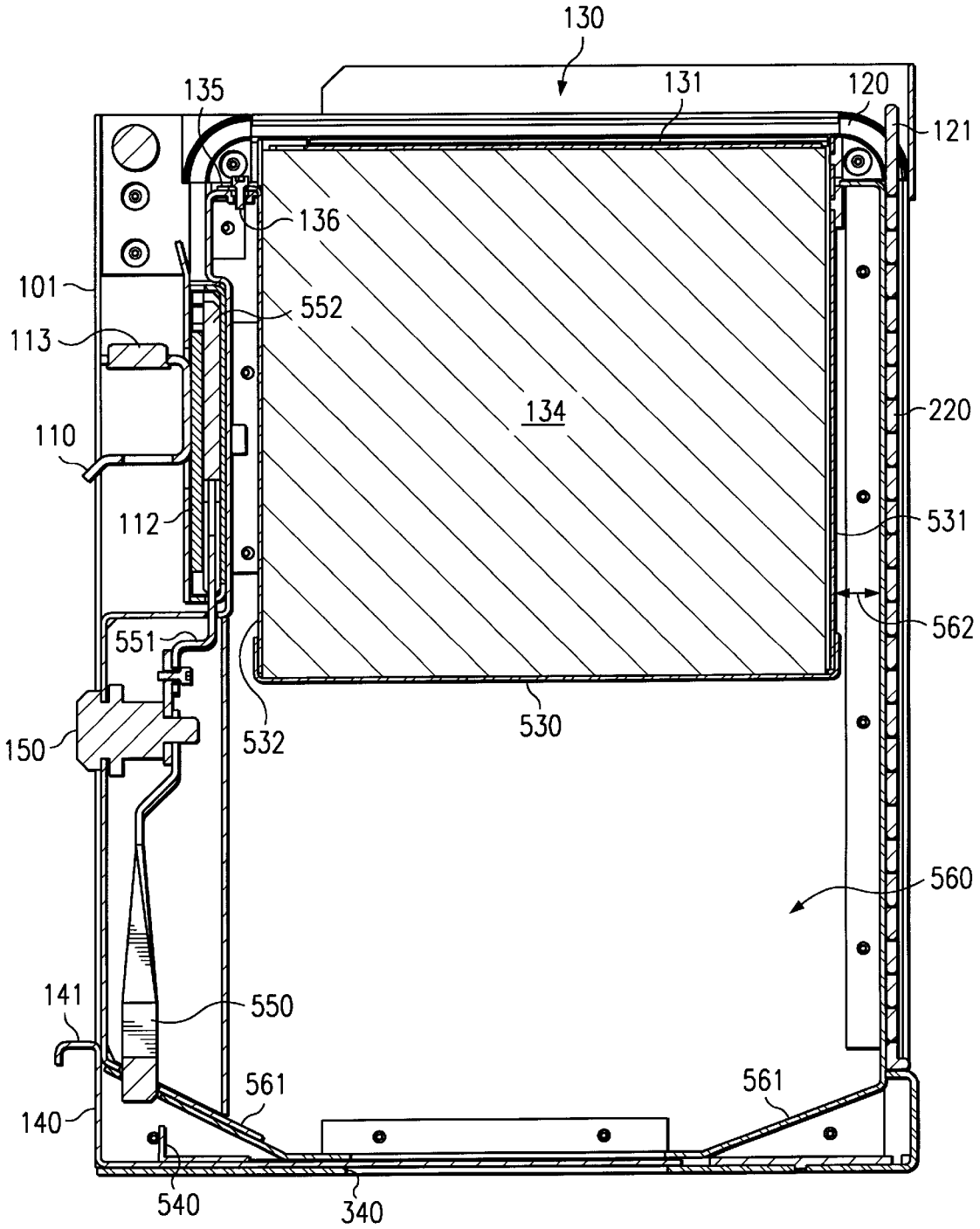
FIG. 5 shows a cross section of the cashbox of FIG. 1.

Directing attention to FIG. 5, a cross section of the preferred embodiment of cashbox 100 is shown. Here the above described box preferred embodiment of note storage insert 130 is shown having box bottom 530, box back 531, and box front 532 containing bias 134 and support surface 131.

Note storage insert 130, in combination with case 101, defines coin storage area 560. As discussed above, the preferred embodiment of coin storage area 560 includes sloped surfaces 561 in order to assist in the substantially complete emptying of the coin storage area by the force of gravity. Additionally, coin storage 560 area includes coin receiving gap 562 defined by box back 531 and case 101.

Also shown in FIG. 5 is the interconnection of locking mechanism 150 and coin retainer 140 through lock linkage 550. When locking mechanism 150 is in a locked position, lock linkage 550 extends downward to engage stop 540 rigidly coupled to coin retainer 140. Accordingly, coin retainer 140 cannot be moved to an open position when locking mechanism is in a locked position.

As described above, coin retainer 140 is preferably adapted to prevent engaging in a host to accept currency when in an open position through the use of extension 141. In order to prevent the removal of coin retainer 140, and thus defeat the prohibition on engaging cashbox 100 in a host when coin release opening 340 is open, coin retainer 140 preferably includes a keeper (not shown) to prevent its removal from case 101. This keeper may be in the form of a brad or a stop to prevent sliding of coin retainer 140 out of case 101 beyond a predetermined point.

Also shown in FIG. 5 is the interconnection of unlocking mechanism 150 and door release 552 through release linkage 551. Operation of door release 552 through interconnection of release linkage 551 with locking mechanism 150 can more readily be seen in the component view of FIG. 6.

Figure 6:
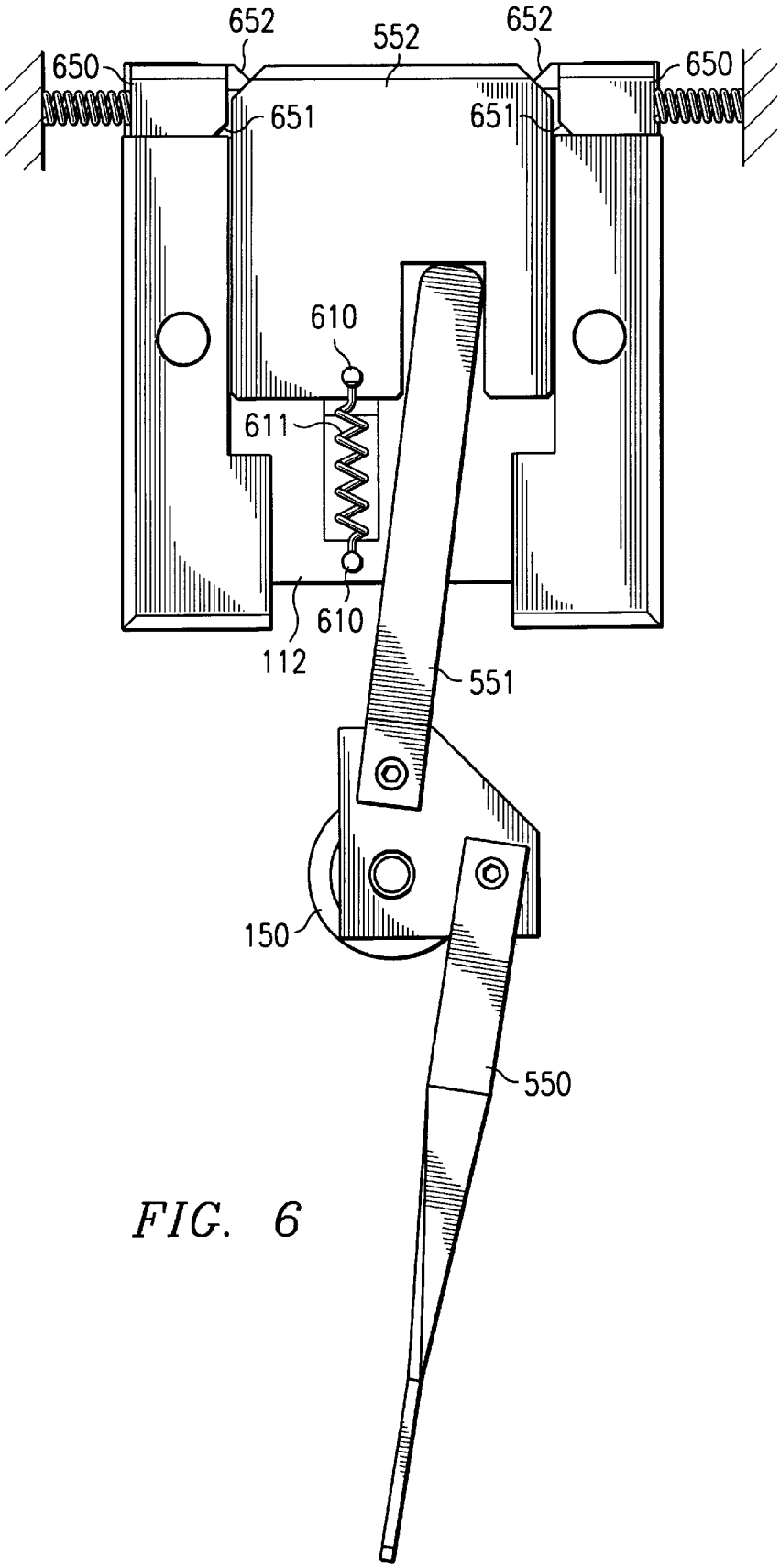
FIG. 6 shows operation of an unlocking mechanism to release a door of the cashbox of FIG. 1.
Figure 7:
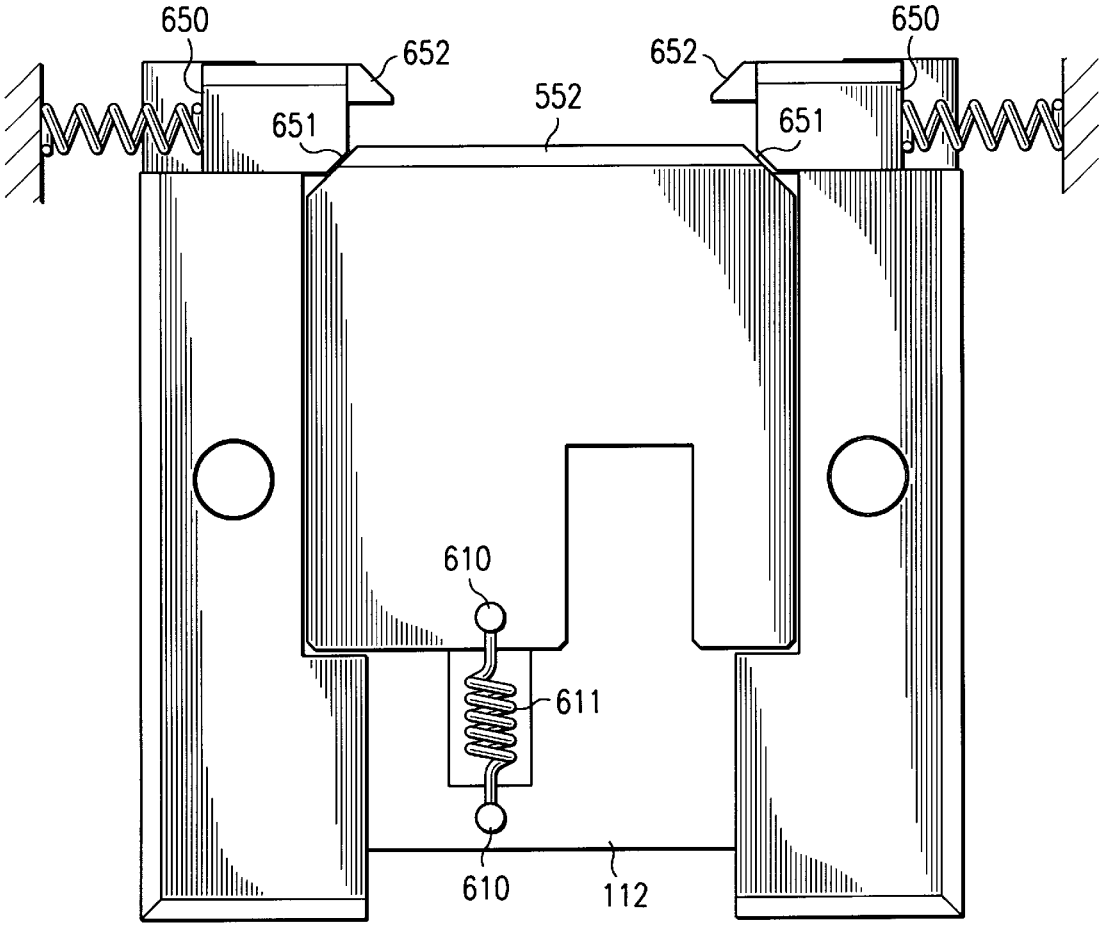
FIG. 7 shows a component view of the door locking mechanism of FIG. 6.

Directing attention to FIG. 6, operation of unlocking mechanism 150 to release door 220 is shown. In operation, release linkage extends upward to force door release 552 to strike shoulders 651 of locking sliders 650 having locking tabs 652 (as shown in FIG. 7). It shall be appreciated that locking tabs 652 are disposed in cashbox 100 to lockably engage tab 121 of door 220. As door release 552 strikes shoulders 651, locking sliders 650 are separated from one another freeing tab 121 of door 220 to allow opening of door 220.

It shall be appreciated from the views in FIGS. 5 and 6 that slider 112 and door release 552 are interconnected. Preferably this interconnection is biased such as through a tension spring 611 coupled to slider 112 and door release 552 at points 610. Accordingly, in a rest state, door release 552 rests on release linkage 551 and, therefore, slider 112 is forced upward by the tension spring. The position of slider 112, door release 552, and locking sliders 650 in a rest state where locking mechanism 150 is in a locked position is shown in FIG. 7.

The interaction of slider 112, door release 552, and locking sliders 650 is important in that it allows the closing and engaging of door 220 with locking sliders 650 to release latch 110 from a bolt rigidly coupled to a host of a preferred embodiment of the present invention. For example, only when tab 121 of door 220 completely engages locking tabs 652 of locking sliders 650 will a leading edge of tab 121 strike a top edge of slider 112. Therefore, through closing and locking door 220, tab 121 may be operated to cause slider 112 to move. Movement of slider 112 allows latch 110, coupled to slider 112 through slot 111, to disengage the bolt of the host.

It shall be appreciated that the above operation of door 220 to disengage cashbox 100 from the bolt of a host provides for the secure transportation of received currency. This is because that, as described above, the currency stored in the coin and note storage areas of cashbox 100 are accessible only through the coin and note feed paths of the host when cashbox 100 is engaged in the host. Furthermore, in order to disengage cashbox 100 from the host, door 220 must be closed and locked, which action also closes a shutter over the coin receiving opening of the coin storage area.

It shall also be appreciated that the above security is provided by the single operation of closing door 220. Accordingly, cashbox 100 may be quickly and securely replaced with another cashbox 100 as needed. For example, where cashbox 100 is disposed in a bus fare collection system, a cashbox containing fares collected during a first bus driver's shift may be easily removed and replaced with a cashbox to receive fare collected during a second bus driver's shift. Likewise, cashboxes may be quickly and securely exchanged in the field when one is filled to capacity.

Figure 8:
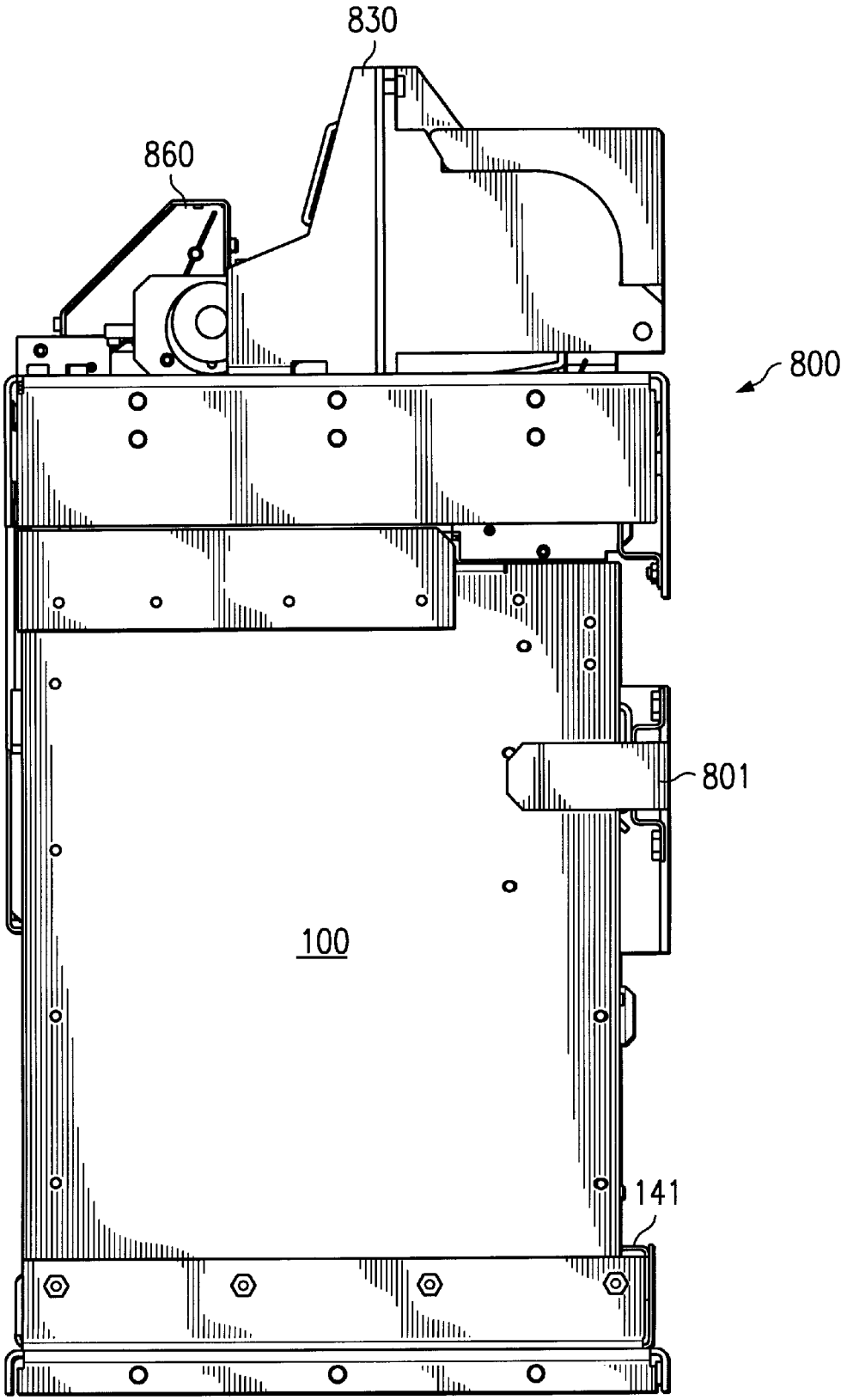
FIG. 8 shows the cashbox of FIG. 1 engaged in a host.

Directing attention to FIG. 8, cashbox 100 of the present invention is shown engaged in host 800 having coin acceptor system 860 and note acceptor system 830. Preferably host 800 and note acceptor system 830 are as shown and described in the above referenced patent application entitled "Automatic Validating Farebox System And Method." Preferably coin acceptor system 860 is as shown and described in the above referenced patent application entitled "System And Method For Coin Singulation." Preferably host 800 and cashbox 100 are utilized as shown and described in the above referenced patent application entitled "System And Method For Providing Farebox Accountability."

As shown in FIG. 8, guide 801 guides cashbox 100 into the host for engaging latch 110 with a bolt (hidden behind guide 800) rigidly coupled to host 800. Also shown in FIG. 8 is extension 141 engaging a surface of host 800 to prevent cashbox 100 from fully engaging latch 110 with the bolt of host 800 when coin retainer 140 is in an open position. It shall be appreciated that a cowling of host 800 is not illustrated in FIG. 8 which restricts access to unlocking mechanism 150 as well as latch 110 when cashbox 100 is inserted into host 800.

Figure 9:
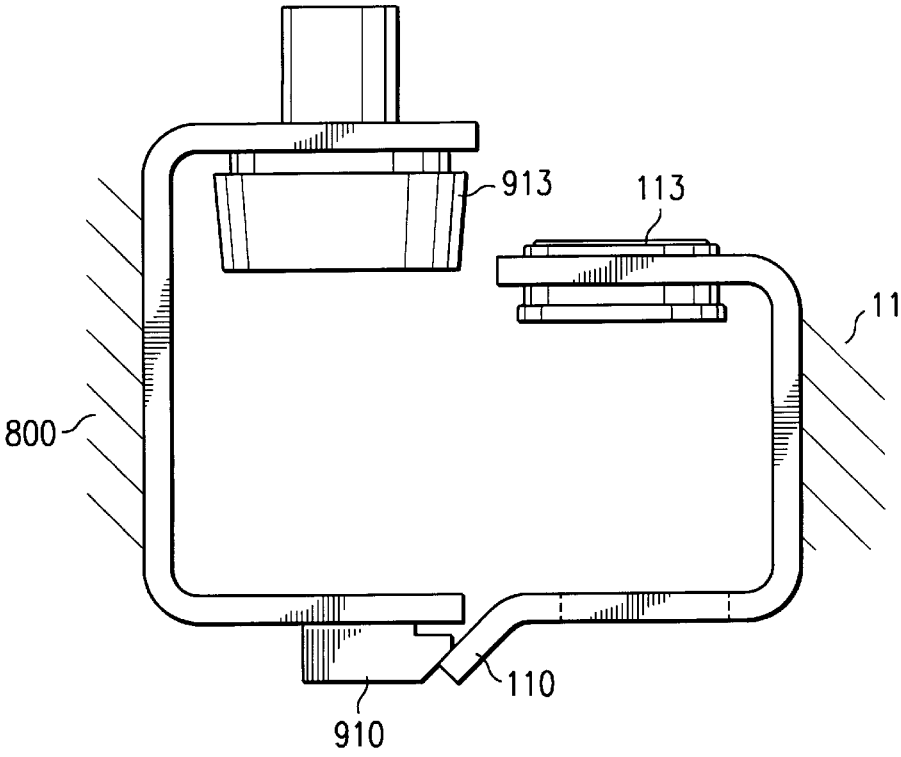
FIGS. 9 and 10 show the operation of a latch of the cashbox of FIG. 1 with a bolt of the host of FIG. 8.
Figure 10:
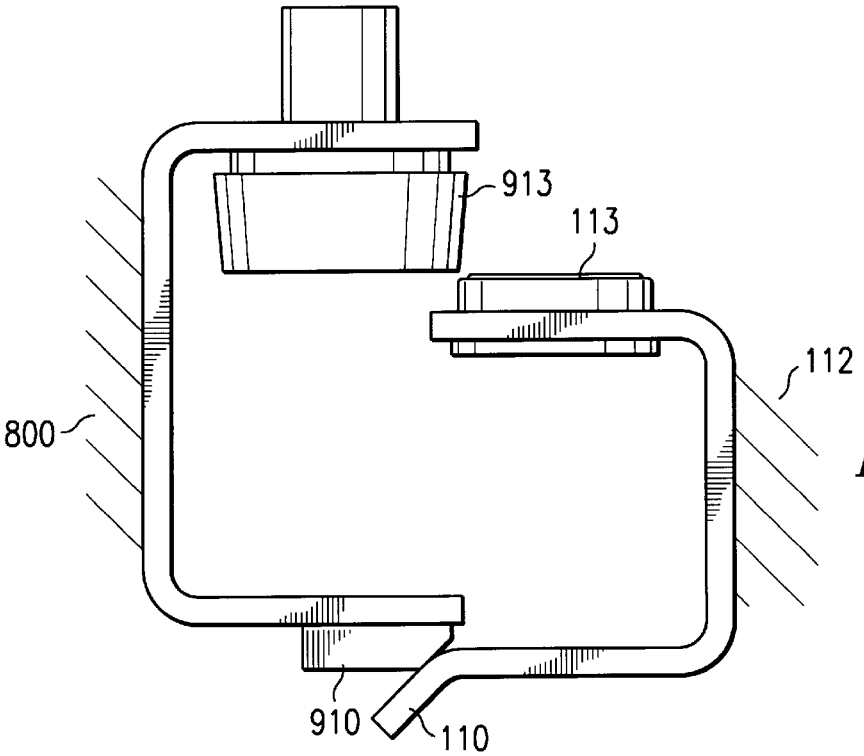

Directing attention to FIGS. 9 and 10, the interaction of latch 110 of cashbox 100 with bolt 910 of host 800 may be seen. As cashbox 100 is slid into host 800, the aforementioned tension spring attached to slider 112 retains latch 110 in an up position. As the ramp on the leading edge of latch 110 engages the ramp on bolt 910, slider 112 allows latch 110 to travel downward to accept bolt 910. Preferably, once accepted by latch 110, bolt 910 may only be disengaged by slider 112 being moved, such as through the aforementioned closing and locking operation of door 220.

Also shown in FIGS. 9 and 10 is the coupling of TMU button 113 to receiver 913 of host 800. As TMU button 113 is coupled to slider 112, operation of latch 110 to engage bolt 910 also causes movement of TMU button 113 to engage receiver 913. Accordingly, insertion of cashbox 100 into host 800 may be detected by host 800 through polling receiver 913 for appropriate information from TMU 113. Therefore, in order to provide secure operation of host 800, i.e., prevent its operation to pass currency to the area where cashbox 100 is supposed to be disposed without cashbox 100 being present to securely receive the currency, host 800 may deactivate itself with respect to currency accepting functions until valid information is received through receiver 913.

Although the present invention has been shown and described with respect to a fare collection system, it shall be appreciated that the cashbox of the present invention may be utilized in any number of currency acceptance systems. For example, the cashbox of the present invention may be utilized in vending machines to provide for accountability of monies received thereby as well as the secure transportability of those receipts when collected by individuals such as route drivers.

Although the present invention and its advantages have been described in detail, it should be understood that various changes, substitutions and alterations can be made herein without departing from the spirit and scope of the invention as defined by the appended claims.

What is claimed is:

1. A configurable system for incarcerating currency including both bills and coins, the system comprising:

a bill storage area for storing bills separately from coins, wherein the bill storage area includes a bill opening disposed to pass an unfolded planar face of a bill;

a coin storage area for storing coins separately from bills, wherein the coin storage area includes a coin opening discrete from the bill opening; and a replaceable dividing surface dividing the bill storage area from the coin storage area, wherein replacing of the dividing surface to enlarge the bill storage area reduces the coin storage area.

2. The system of claim 1, wherein the replaceable dividing surface comprises:

a bill storage insert having a bill receiving surface disposed to receive an unfolded planar face of a bill, and having a bill retainer adapted to allow passage of a planar face of a bill when passed into the bill storage insert and to retain the bill thereafter.

3. The system of claim 2, wherein the bill storage insert further comprises:

a biasing mechanism coupled to the bill receiving surface to tightly compress received bills between the bill receiving surface and the bill retainer.

4. The system of claim 3, wherein the biasing mechanism includes a compression spring.

5. The system of claim 3, wherein the biasing mechanism includes a compressible resilient material.

6. The system of claim 1, further comprising:

a bill shutter to cover to the bill opening of the bill storage area, wherein the bill shutter does not cover to the coin opening of the coin storage area.

7. The system of claim 6, wherein the bill shutter comprises:

a door having an open position and a closed position, wherein the door in the open position provides access to the bill opening of the bill storage area, and wherein the door in the closed position prohibits access to the bill opening of the bill storage area.

8. The system of claim 7, wherein the door is a tambour door.

9. The system of claim 7, wherein the door in the closed position engages a locking mechanism to temporarily prevent the door from being moved to the open position.

10. The system of claim 9, wherein the system is positionable in a currency collection device, wherein when the system is so positioned and the door is open the system is restrained within the currency collection device, and wherein the system further comprises a mechanism to release the system from being restrained operable only when the door is moved to the closed position and engages the locking mechanism.

11. The system of claim 9, further comprising:

an unlocking mechanism to disengage the door from the locking mechanism.

12. The system of claim 11, further comprising:

a coin release opening; and a coin retainer having an open position and a closed position, wherein the coin retainer in the open position provides coin egress from the coin storage area, and wherein the coin retainer in the closed position prohibits coin egress from the coin storage;

a locking mechanism to retain the coin retainer in the closed position, wherein the unlocking mechanism also provides unlocking of the coin retainer locking mechanism.

13. A cashbox for incarcerating currency including both bills and coins, wherein the bills are retained in a tight stack, the system comprising:

a bill storage area for storing tightly stacked bills separately from coins, wherein the bill storage area includes a bill opening disposed to pass an unfolded planar face of a bill, and wherein the bill opening is adapted to receive bills passed by a coupled currency accepting apparatus; and a coin storage area for storing coins separately from bills, wherein the coin storage area includes a coin opening discrete from the bill opening, and wherein the coin opening is adapted to receive coins passed by the coupled currency accepting apparatus.

14. The cashbox of claim 13, further comprising:

a replaceable dividing surface dividing the bill storage area from the coin storage area, wherein replacing of the dividing surface to enlarge the bill storage area reduces the coin storage area.

15. The cashbox of claim 14, wherein the replaceable dividing surface comprises:

a bill storage insert having a bill receiving surface disposed to receive an unfolded planar face of a bill, and having a bill retainer adapted to allow passage of a planar face of a bill when passed into the bill storage insert and to retain the bill thereafter.

16. The cashbox of claim 15, wherein the bill storage insert further comprises:

a biasing mechanism coupled to the bill receiving surface to tightly compress received bills between the bill receiving surface and the bill retainer.

17. The cashbox of claim 13, further comprising:

a bill shutter to cover to the bill opening of the bill storage area.

18. The cashbox of claim 17, wherein the bill shutter comprises:

a door having an open position and a closed position, wherein the door in the open position provides access to the bill opening of the bill storage area, and wherein the door in the closed position prohibits access to the bill opening of the bill storage area.

19. The cashbox of claim 18, wherein the door in the closed position engages a locking mechanism to temporarily prevent the door from being moved to the open position.

20. An adjustable currency storage system providing storage of notes wherein an area of storage provided for notes may be adjusted to store a desired amount of notes, the system comprising:

means for retractably accepting notes into a note storage area;

means for retaining accepted notes in a common orientation and a tightly compressed bundle; and means for changing the area of storage provided for notes including a plurality of note storing bins of different sizes.

21. The system of claim 20, further comprising:

means for storing coins separately from the notes.

22. The system of claim 20, wherein the retractable accepting means comprises:

means for supporting a planar surface of accepted notes; and means for biasing the supporting means to provide a compression force between the supporting means and the retaining means.

23. The system of claim 20, further comprising:

means for restricting access to accepted notes retained by the retaining means.

24. The system of claim 23, wherein the restricting means comprises:

a locking tambour door.

25. The system of claim 23, wherein the access restricting means comprises:

means for releasing a latch when the access restricting means is in a closed and locked position.

26. A method for adjustably storing currency providing separate storage of notes and coins, wherein adjustment of an area of storage provided for notes inversely adjusts an area of storage provided for coins, the method comprising the steps of:

defining a note storage area in a currency storage container to have a selected volume thereby also defining a coin storage area in the currency storage container;

storing notes in the note storage area, wherein the note storing step comprises the steps of:

retractably accepting notes into the note storage area; and retaining the accepted notes in a common orientation and a tightly compressed bundle;

storing coins in the coin storage area.

27. The method of claim 26, wherein the step of defining the note storage area comprises the steps of:

selecting a note storing bin from a plurality of note storing bins of different sizes; and coupling the selected note storing bin to a container thereby also at least in part defining the coin storage area.

28. The method of claim 26, wherein the step of retractably accepting notes comprises the steps of:

supporting a planar surface of accepted notes; and providing a compression force between the supported planar surface of accepted notes and a retainer of the retaining step.

29. The method of claim 26, further comprising the step of:

restricting access to retained notes.

30. The method of claim 29, wherein the step of restricting access comprises the steps of:

incarcerating the note storage area and coin storage area within a note and coin acceptor, wherein access to the note storage area is only provided through a note feed path of the note and coin acceptor; and closing and locking the note storage area prior to allowing the extrication of the note storage area and coin storage area from incarceration.

31. A container for securely storing currency comprising:

a currency storage area for storing received currency, wherein the currency storage area has at least one opening disposed to receive currency;

a door having an open position and a closed position, wherein the door in the open position provides access to the currency storage area through the at least one opening, and wherein the door in the closed position engages a locking mechanism to prohibit access to the currency storage area through the at least one opening;

a latch to restrain portability of the container when engaged in a corresponding receiver; and a mechanism to release the latch restraining portability of the currency incarcerating system, wherein said release mechanism is operated to release the container through the door engaging the locking mechanism.

32. The container of claim 31, wherein the latch is disposed on a slider, wherein when the door is in the closed position and engages the locking mechanism, the door also engages the slider to cause a releasing movement of the latch.

33. The container of claim 32, wherein the slider comprises:

an electronic storage device mounted thereon storing unique identification information of the container, wherein engaging of the slider by the door also causes the electronic storage device to decouple from an interface.

34. The container of claim 33, wherein the unique identification information of the container stored in the electronic storage device may be read by a host system prior to its decoupling from the interface.

35. The container of claim 31, wherein the currency includes coin and bill, wherein the container further comprises:

a bill storage area; and a coin storage area, wherein the coin storage area is isolated from the bill storage area.

36. The container of claim 35, wherein the bill storage area is adjustable to a selected volume.

37. The container of claim 36, wherein adjustment of the bill storage area is provided by inserting a selected bin of a plurality of different sized bins into the container.

38. The container of claim 36, wherein the bins of the plurality of different sized bins are adapted to at least in part define the coin storage area within the container when inserted, and wherein the bins are also adapted to provide the definition of the coin storage area without presenting voids in which coins may be trapped.

39. The container of claim 36, wherein adjustment of the bill storage area is provided by a movable partition inserted into the container.

40. A configurable system for incarcerating currency including both bills and coins, wherein an area for incarcerating the bills is adjustable to thereby provide different amounts of bill incarceration area and thus providing corresponding different amounts of coin incarceration area, the system comprising:

a case for storing bills and coins, wherein the case includes a bill opening disposed to accept an unfolded planar face of a bill, wherein the case also includes a coin opening discrete from the bill opening; and a bill storage insert having a bill storage opening disposed to accept an unfolded planar face of a bill, wherein the bill storage insert is adapted for insertion into the case and having means for mounting to hold the bill storage opening of the bill storage insert in juxtaposition with the bill opening of the case.

41. The system of claim 40, wherein the bill storage insert comprises:

a bill receiving surface disposed to receive an unfolded planar face of a bill; and a bill retainer disposed at the bill storage opening of the bill storage insert adapted to allow passage of a planar face of a bill when received into the bill storage insert and to retain the bill thereafter.

42. The system of claim 41, wherein the bill storage insert further comprises:

a biasing mechanism coupled to the bill receiving surface to tightly compress received bills between the bill receiving surface and the bill retainer.

43. The system of claim 40, wherein the case comprises:

a bill shutter to securely close the bill opening of the case; and a coin shutter to securely close the coin opening of the case.

44. The system of claim 43, wherein operation of the bill shutter to close the bill opening of the case also operates the coin shutter to close the coin opening of the case.

45. The system of claim 40, wherein the case comprises:

a bill shutter to close the bill opening of the case, wherein the bill shutter includes a tambour door disposed in a track to allow retraction to open the bill opening of the case and expose the bill storage opening of the bill insert, and a locking mechanism disposed at an end of the tambour door to provide locking of the tambour door when in a closed position.

46. The system of claim 45, wherein the case further comprises:

a latch mechanism to securely couple the case in a bill and coin accepting device, wherein the latch may only be released by fully closing and locking the bill shutter.

47. The system of claim 46 wherein the case further comprises:

a limited access release mechanism to provide unlocking of the tambour door.

48. The system of claim 47, wherein the release mechanism is disposed on the case so as to be inaccessible when the case is coupled in the bill and coin accepting device.

49. The system of claim 46, wherein the case further comprises:

a coin release opening; and a coin retainer disposed to cover the coin release opening when in a closed position, wherein the release mechanism provides unlocking of the coin retainer.

50. The system of claim 49, wherein the coin retainer is adapted to prohibit coupling the case in the bill and coin accepting device when the coin retainer is not in the closed position.

51. The system of claim 46, wherein the case comprises:

machine readable unique identification information.

52. The system of claim 51, wherein the machine readable unique identification information is stored in a touch memory utility button coupled to the case.

53. A configurable cashbox system for securely storing currency including both bills and coins, wherein an area for storing the bills is adjustable to thereby provide different amounts of bill storage area and thus providing corresponding different amounts of coin storage area, the system comprising:

a case for storing bills and coins, wherein the case includes a bill opening disposed to accept an unfolded planar face of a bill, wherein the case also includes a coin opening;

a bill storage insert having a bill storage opening disposed to accept an unfolded planar face of a bill, a bill receiving surface disposed to receive an unfolded planar face of a bill, a bill retainer disposed at the bill storage opening of the bill storage insert adapted to allow passage of a planar face of a bill when received into the bill storage insert and to retain the bill thereafter, and a biasing mechanism coupled to the bill receiving surface to tightly compress received bills between the bill receiving surface and the bill retainer, wherein the bill storage insert is adapted for insertion into the case and having means for mounting to hold the bill storage opening of the bill storage insert in juxtaposition with the bill opening of the case; and a bill shutter to close the bill opening of the case, wherein the bill shutter includes a tambour door disposed in a track on the case to allow retraction to open the bill opening of the case and expose the bill storage opening of the bill insert, and a locking mechanism disposed at an end of the tambour door to provide locking of the tambour door when in a closed position.

54. The system of claim 53, further comprising:

a coin shutter to securely close the coin opening of the case.

55. The system of claim 54, wherein operation of the bill shutter to close the bill opening of the case also operates the coin shutter to close the coin opening of the case.

56. The system of claim 53, wherein the case further comprises:

a latch mechanism to securely couple the case in a bill and coin accepting device, wherein the latch may only be released by fully closing and locking the bill shutter.

57. The system of claim 53, wherein the case comprises:

machine readable unique identification information.

58. The system of claim 57, wherein the machine readable unique identification information is stored in a touch memory utility button coupled to the case.

* * * * *